US005827117A

United States Patent [19]

Naas

[11] Patent Number: 5,827,117

[45] Date of Patent: Oct. 27, 1998

[54] COIN SORTER AND PACKAGER

[75] Inventor: Robert L. Naas, Skaneateles, N.Y.

[73] Assignee: Mag-Nif Incorporated, Mentor, Ohio

[21] Appl. No.: 645,106

[22] Filed: May 13, 1996

[51] Int. Cl.[6] ..... G07D 3/08

[52] U.S. Cl. ..... 453/9; 453/61

[58] Field of Search ..... 453/9, 12, 13, 453/58–62; 53/254, 213

[56] References Cited

U.S. PATENT DOCUMENTS

| | | | |
|---|---|---|---|
| D. 296,029 | 5/1988 | Knox | D99/34 |
| 2,423,502 | 7/1947 | Jorgensen | 453/9 |
| 3,161,351 | 12/1964 | Lerner . | |
| 3,338,250 | 8/1967 | Mehelich | 453/9 |
| 3,410,385 | 11/1968 | Freet et al. . | |
| 3,424,931 | 1/1969 | Wandrey . | |
| 3,882,659 | 5/1975 | Charlop | 453/62 X |
| 4,095,607 | 6/1978 | Newton et al. | 453/61 |
| 4,154,252 | 5/1979 | Elias | 453/59 |
| 4,820,237 | 4/1989 | Shinozaki et al. | 453/59 X |
| 4,987,990 | 1/1991 | Perkitny | 453/5 X |
| 4,995,848 | 2/1991 | Goh | 453/9 X |
| 5,006,091 | 4/1991 | Reavley | 453/59 |
| 5,122,093 | 6/1992 | Perkitny | 453/13 |
| 5,232,399 | 8/1993 | LeHong et al. | 453/57 |
| 5,474,496 | 12/1995 | Perkitny | 453/9 |

FOREIGN PATENT DOCUMENTS

| | | | |
|---|---|---|---|
| 412052 | 6/1934 | United Kingdom | 453/13 |
| 2130779 | 6/1984 | United Kingdom | 453/9 |

OTHER PUBLICATIONS

Magnif Just For Fun catalog entitled "Magnif Banks Puzzles Games Gifts" (8 double sided sheets) (1994).

*Primary Examiner*—F. J. Bartuska
*Attorney, Agent, or Firm*—Fay, Sharpe, Beall, Fagan, Minnich & McKee

[57] ABSTRACT

A device for stacking coins, including at least one coin stacking well and a wedge positioned at a bottom of the coin stacking well. In one embodiment, the device sorts and packages different sized coins in coin wrappers using: (1) an input chute for receiving the coins into a hopper, (2) a guide for guiding the coins from the hopper along a predetermined path, the guide having a bottom surface with multiple apertures in the bottom surface, substantially coinciding with the predetermined path and each of the apertures becoming progressively larger in one direction; (3) a plurality of coin stacking wells for receiving the coins; (4) a plurality of coin chutes for directing coins from a respective aperture into a respective coin stacking well; and (5) a wedge positioned at the bottom of each coin stacking well. The wedge may be formed with a platform section and an angled section such that the end of an unfolded coin wrapper surrounds the bottom of the platform. The platform and angled portion having a height sufficient to cause excess coins to land above the edge of the other end of the coin wrapper and coin stacking well and thus, not be retained in the coin stack but to slide off the downward direction of slant of the angled portion.

30 Claims, 6 Drawing Sheets

FIG. 5(a)
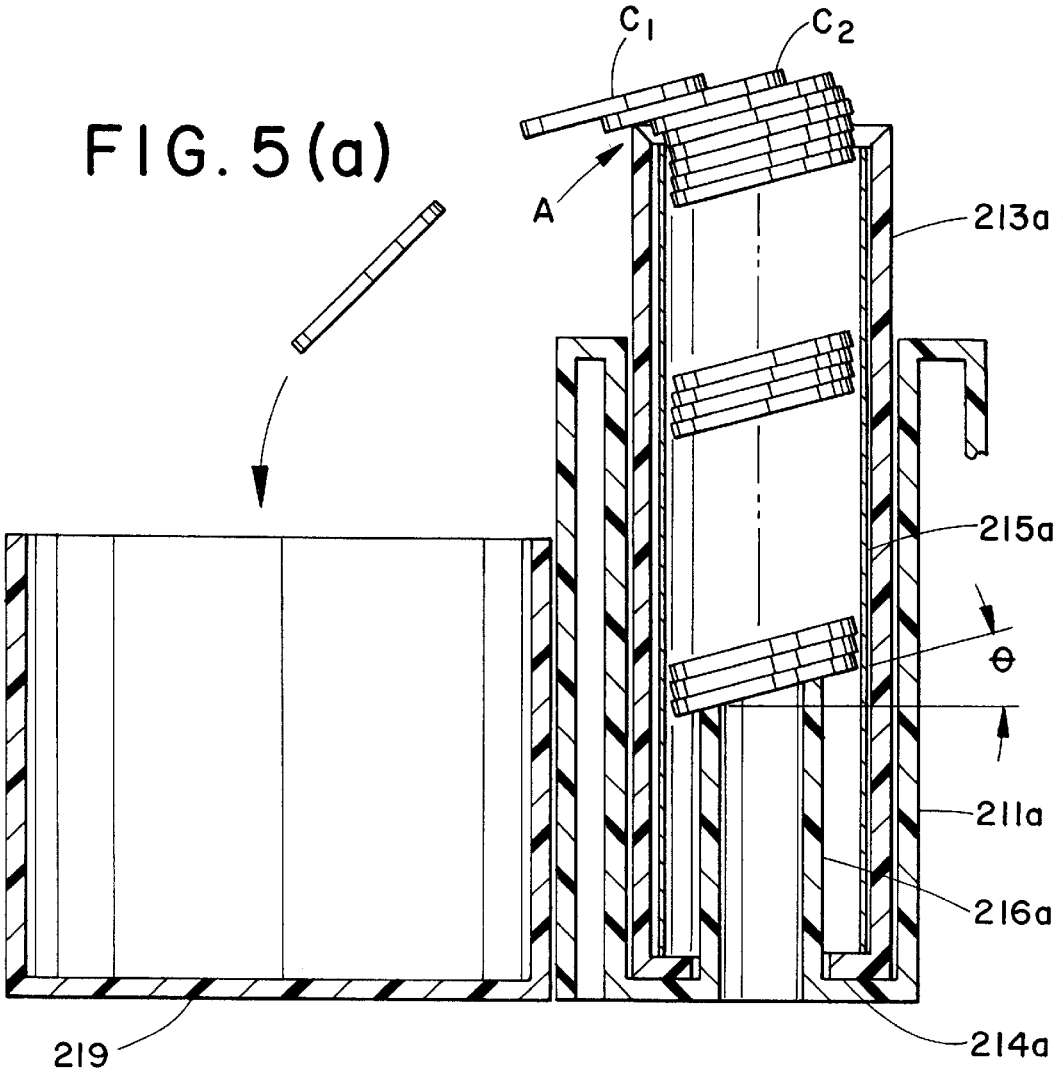
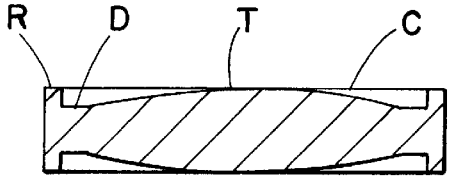
FIG. 5(b)
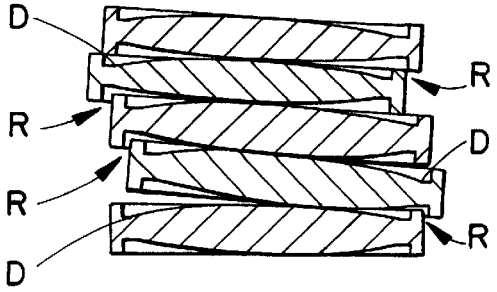
FIG. 5(c)
(PRIOR ART)

FIG. 6
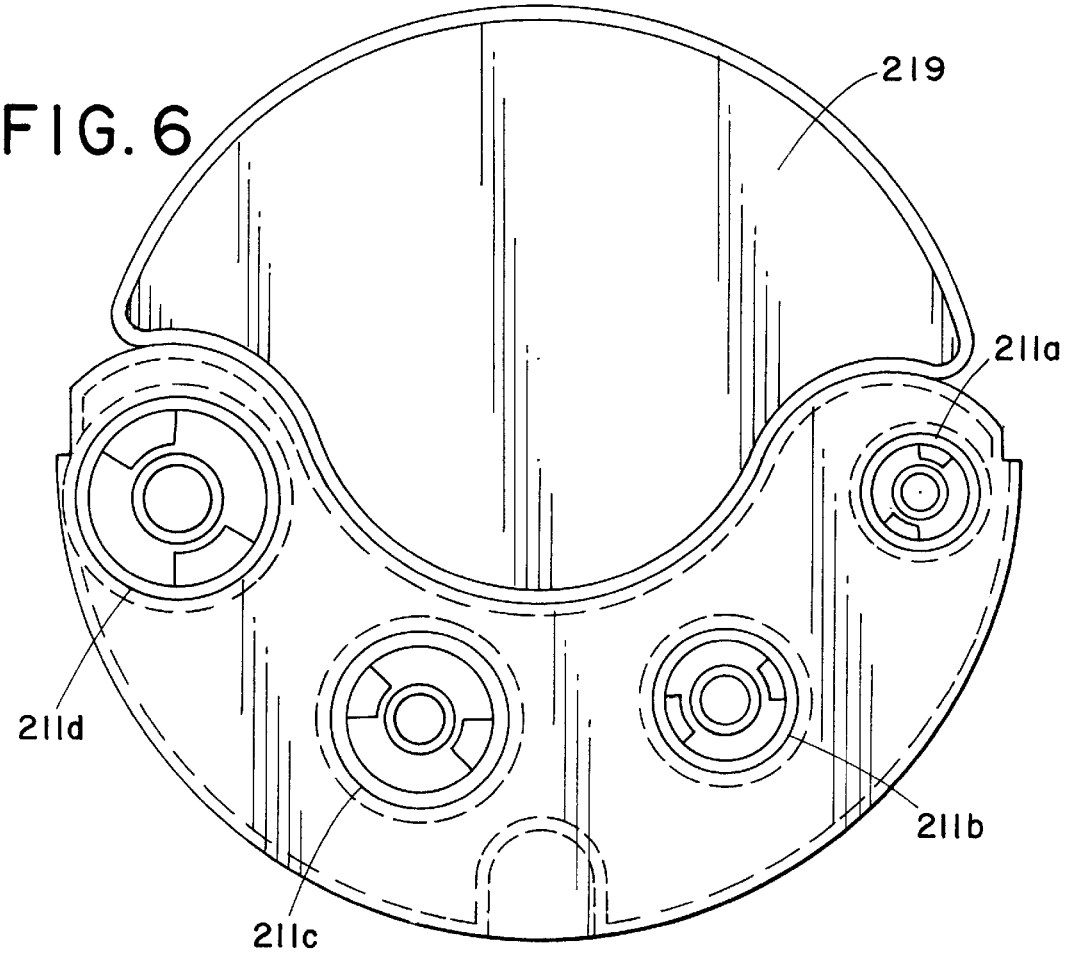
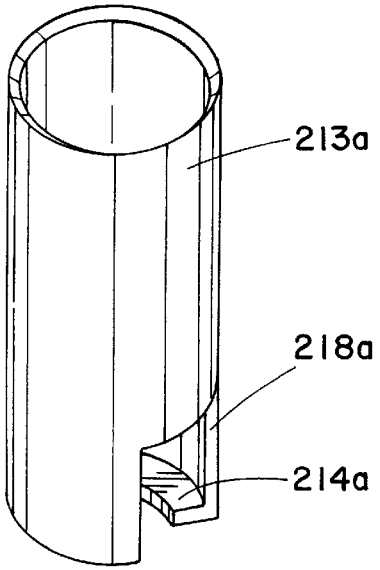
FIG. 7(a)
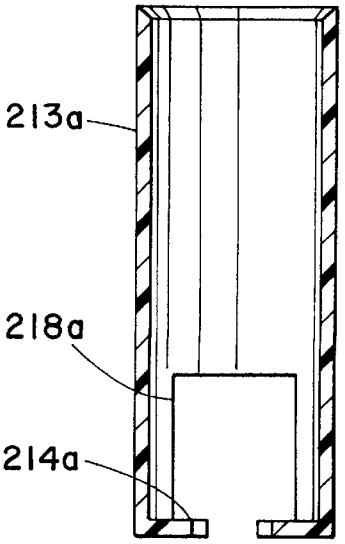
FIG. 7(b)

COIN SORTER AND PACKAGER

BACKGROUND OF THE INVENTION

1. Field of Invention

The present invention relates to a device for sorting and packaging coins of different denominations and, more particularly, to such a device which can detect, redirect and/or hold excess coins that would otherwise overfill the coin packages.

2. Description of the Background

Coin sorting devices are useful for quickly and easily sorting and packaging coins of different denominations. Typically, conventional devices receive one or more coins of different denominations and direct coins of the same denomination into a respective coin package, usually a coin wrapper, which is made of plastic or paper.

Such conventional devices operate by causing coins to be moved along a predetermined path which has multiple sorting slots; one for each type of coin to be sorted. In operation, each coin drops through a respectively sized sorting slot into a coin wrapper which can be held in a receiving tube. One example of such a conventional device is shown in U.S. Pat. No. 5,474,496, to Perkitny. In the bank discussed in U.S. Pat. No. 5,474,496, the coins roll along a predetermined path on their edges and the sorting slots are arranged such that the coins fall through the slots positioned primarily in the outer side wall of the path. U.S. Design Pat. No. 347,929 to Perkitny shows a similar design.

Another conventional device is discussed in U.S. Pat. No. 3,338,250 to Mehelich. In U.S. Pat. No. 3,338,250, the coins slide along a predetermined path on their faces and fall through apertures primarily positioned along the bottom of the path.

One disadvantage of such conventional sorting banks is that, if more than a certain number of coins of a particular denomination are inserted into the device to be sorted, these extra coins extend the coin stack over the top of the coin wrapper. Such a coin stack is depicted in FIG. 1.

As seen in this FIG. 1, coins C are stacked horizontally in coin wrapper 1 placed within receiving tube 3. Receiving tube 3 has coin platform 3*a*, for raising the stack of coins above the bottom edge of the coin wrapper 1. Optimally, coins are stacked only as high as point "A" so that when the coin wrapper 1 containing the stacked coins is removed from receiving tube 3 the coins drop to a rolled-over-portion 4 at the bottom of coin wrapper 1 and leave a folding section empty at the top of coin wrapper 1 substantially equal to the height of the coin platform 3*a*. This empty folding section then may be folded down to enclose the coins within the coin wrapper 1.

However, when coins C stacked in a coin wrapper 1 extend above point "A" removal of the coin wrapper 1 from the receiving tube 3 causes the excess coins to fill the folding section of the coin wrapper preventing fold-over of the folding section. Further, since coin wrappers are expected to hold a specific number of coins, for example, 50 pennies, the excess coins cause a non-standard number of coins to be stacked in the coin wrapper.

Moreover, the excess coins also tend to drop off the horizontal coin stack in random directions, and scatter all about the device, requiring the user to pick up the scattered coins.

OBJECTS AND SUMMARY OF THE INVENTION

Accordingly, it is an object of the present invention to provide a device for accurately sorting and packaging coins of different denominations.

It is another object of the present invention to provide a device for sorting and packaging coins of different denominations having means for containing excess coins that overflow from the coin packages.

It is another object of the present invention to provide a device for sorting and packaging coins of different denominations having a wedge positioned at the bottom of each respective coin stack for causing excess coins to be accurately and reliably directed to a chosen location.

It is another object of the present invention to provide a device for sorting and packaging coins into coin wrappers which does not require that one end of each coin wrapper be folded or formed with a lip before the coins are inserted.

According to a first embodiment of the present invention a device for stacking coins is provided, having at least one coin stacking well and a wedge positioned at the bottom of the coin stacking well.

The device may further have a coin wrapper, the coin wrapper being inserted into a coin stacking well with one end of the coin wrapper surrounding the wedge. In addition, the wedge may have a platform section and an angle section. The angle section may be at an angle of about 35 degrees with respect to the platform section.

The device may further comprise a coin wrapper holder, one end of the coin wrapper holder being placed around the wedge. The coin wrapper holder may also have a ledge at one end. Further, the coin wrapper holder can have at least one slot extending through the ledge along a portion of the coin wrapper holder. Each coin wrapper holder can hold a coin wrapper.

According to another aspect of the present invention a device for sorting coins and packaging the sorted coins in coin wrappers is provided, which has means for receiving the coins; guide means for guiding the coins from the means for receiving along a predetermined path; the guide means having a bottom surface and an outer guide wall; a plurality of apertures in the bottom surface substantially coinciding with the predetermined path, each of the apertures becoming progressively larger in one direction; a plurality of coin stacking wells for receiving the coin wrappers and the coins; a plurality of coin chutes for directing coins from a respective aperture to a respective coin stacking well; and a plurality of wedges, a respective wedge positioned at the bottom of each coin stacking well. Also, the means for receiving can be a funnel-shaped input chute.

The device may also have a coin movement means, which can be a rotating disk, for moving the coins from the means for receiving to the guide means. The rotating disk may be rotated by an electric motor. In addition, the device may have an overflow chamber for receiving coins falling away from the coin wrappers when the coin wrappers become filled with coins. The angled section of the wedge, which may be at an angle of about 35 degrees with respect to the platform section, may be oriented to direct the excess coins into the overflow chamber.

Also, in some embodiments, the wedge can have an angle of about 35 degrees relative to the coin well bottom. Further, four of the apertures may be slightly larger than a penny, a dime, a nickel, and a quarter, respectively.

In addition, the bottom surface of the guide path may be inclined upward from the outer guide wall to the opposite edge of the guide means. Also, the guide means can have a spiral shape between the receiving means and the apertures.

Furthermore, this device may have a plurality of coin wrapper holders for holding the coin wrappers; each of the plurality of coin wrapper holders being adapted to be placed within a respective one of the coin stacking wells. In addition, a coin wrapper holder may have finger grooves formed on opposite sides of a bottom area to permit the folding over of a bottom end of a coin wrapper placed within the coin wrapper holder.

The above and other objects, features, and advantages of the present invention will become apparent from the following detailed description of the preferred embodiments to be read in conjunction with the accompanying drawings.

BRIEF DESCRIPTION OF THE DRAWINGS

FIG. 5(*a*) is a cross-sectional view showing the controlled coin runoff of the embodiment of the invention shown in FIGS. 2(*a*) and 2(*b*), FIG. 5(*b*) shows a detailed cross section of a coin, and FIG. 5(*c*) shows a detailed cross section of a conventional horizontal coin stack;

FIG. 6 is a top view of the coin stacks and coin storage compartment of the embodiment of the invention shown in FIGS. 2(*a*) and 2(*b*); and FIG. 7(*a*) is a perspective view of a coin wrapper holder according to an embodiment of the invention and FIG. 7(*b*) is a cross-sectional view of the coin wrapper holder of FIG. 7(*a*).

DETAILED DESCRIPTION OF THE DRAWINGS

Figure 2A:
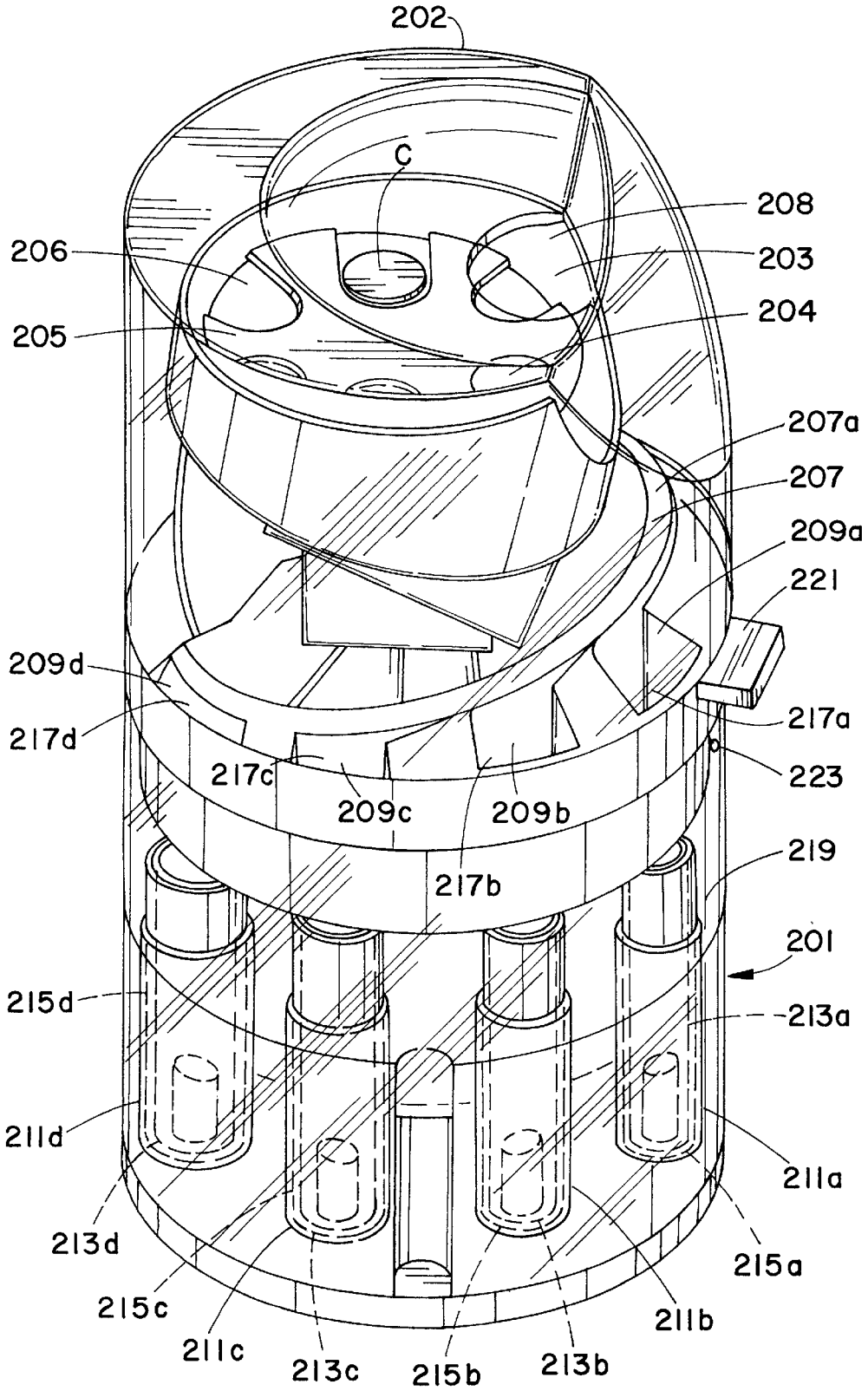
FIG. 2(*a*) is a perspective view of an embodiment of the coin sorter and packager device according to the instant invention and FIG. 2(*b*) is a top view of the device of FIG. 2(*a*)
Figure 2B:
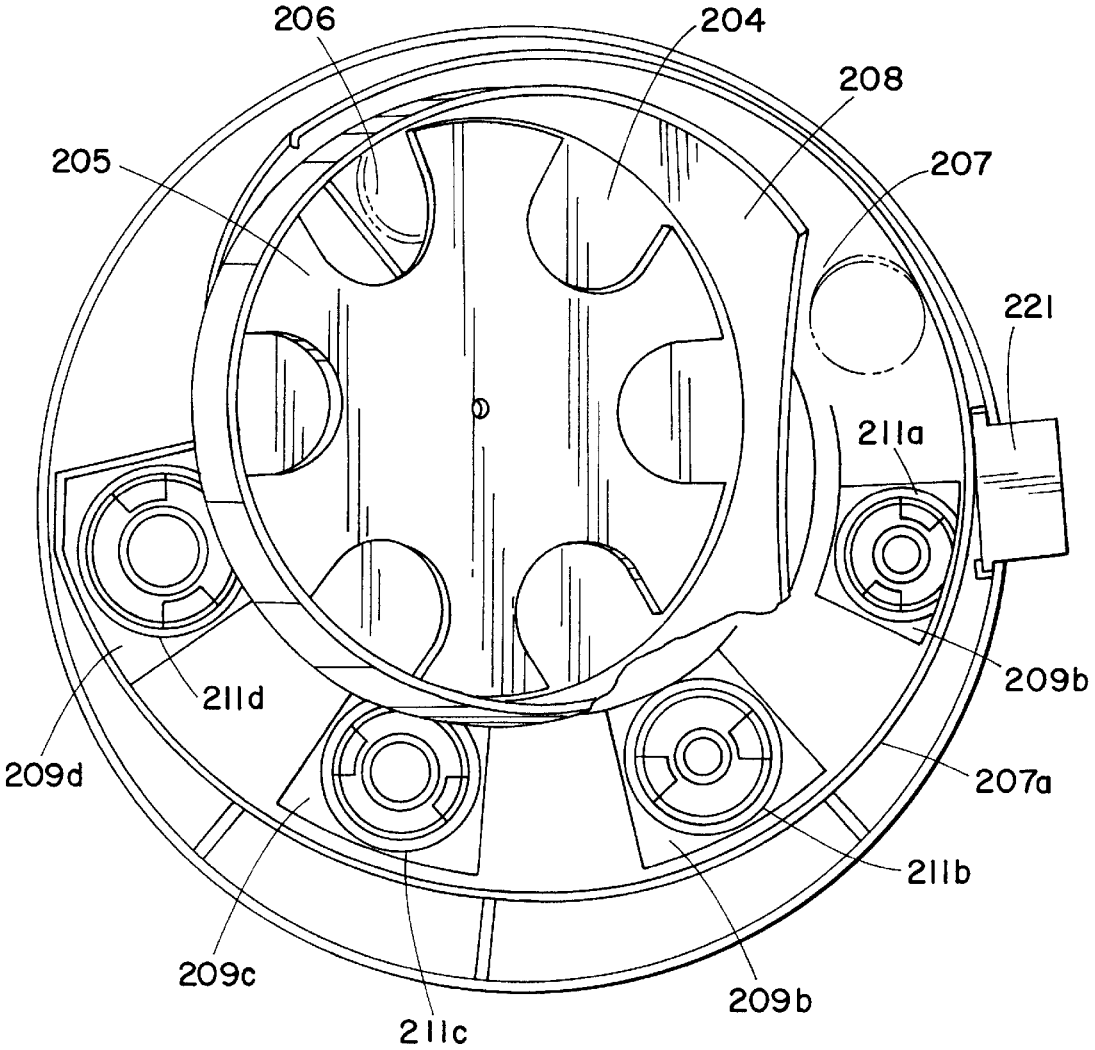

FIG. 2(*a*) shows a perspective view of an embodiment of the instant invention with top 202 and FIG. 2(*b*) shows the same embodiment with top 202 removed. In FIG. 2(*a*) the coin sorter and packager 201 includes an input port 203 disposed within a top 202 for receiving coins and a hopper 208 for holding received coins. The hopper 208 includes a disk 205 which is rotated by a motor (not shown) to move the received coins onto guide path 207. As shown more clearly in FIGS. 2(*b*), 3(*a*), and 3(*b*) guide path 207 is bounded on the outside circumference by outer guide wall 207*a* and includes bottom surface 207*b*, upon which coins slide on their faces. Aperture 209*a* in bottom surface 207*b* is sized to be larger than a dime but smaller than a penny, aperture 209*b* is sized to be larger than a penny but smaller than a nickel, aperture 209*c* is sized to be larger than a nickel but smaller than a quarter, and aperture 209*d* is sized to be larger than a quarter. Additional apertures (not shown) may be included. For example, one of the apertures can be sized to be larger than a half dollar coin and the other can be sized to be larger than a dollar coin. Alternatively, the apertures can be sized appropriately to sort coins of different countries or tokens. Preferably, while the minimum sizes of the apertures are as described above, apertures which are longer in length, that is, the direction along the guide path 207 in which coins slide, allow the coins to fall through more easily so long as the aperture height is kept slightly smaller than the next coin size.

Coin stacking wells 211*a*–211*d* are disposed beneath respective apertures 209*a*–209*d*. The coin stacking wells 211*a*–211*d* are adapted to receive coin wrapper holders 213*a*–213*d* which, in turn receive coin wrappers 215*a*–215*d*. Coin chutes 217*a*–217*d*, which correspond respectively with coin stacking wells 211*a*–211*d* and apertures 209*a*–209*d* are used to guide coins from the apertures into the wells; each well containing a coin wrapper holder and a coin wrapper, as discussed in more detail below. Also, as seen in FIG. 5(*a*), coin storage chamber 219 is disposed adjacent to coin stacking wells 211*a*–211*d* and is used to capture excess coins as described below.

The coin sorter and packager 201 includes switch actuator 221 for turning a motor on and off to rotate disk 205. This motor may be powered by one or more batteries (not shown) or by a power supply (not shown) connected to terminal 223. The power supply is preferably powered by standard household current when plugged into a regular electrical outlet. Alternatively, other power sources can be used which are powered by other means, for example, direct current.

Figure 1:
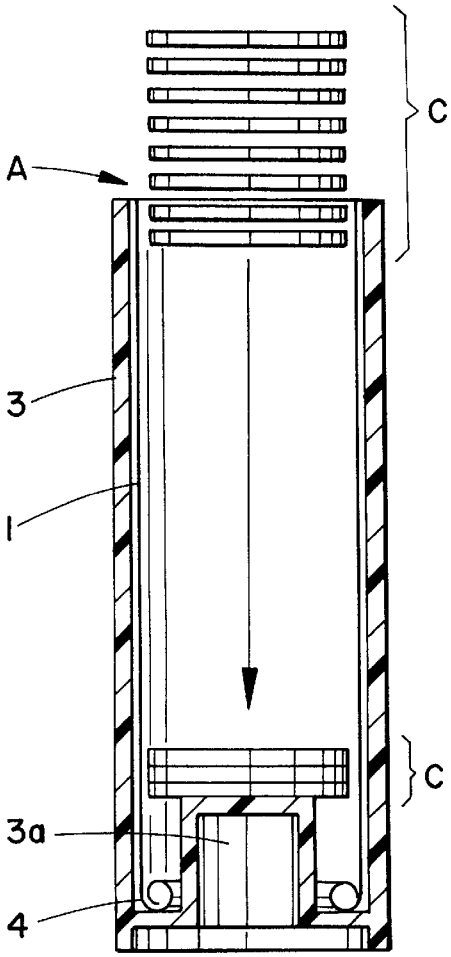
FIG. 1 (PRIOR ART)
FIG. 1 is a cross-sectional view of a horizontal coin stack created by a conventional coin sorter.
Figure 3A:
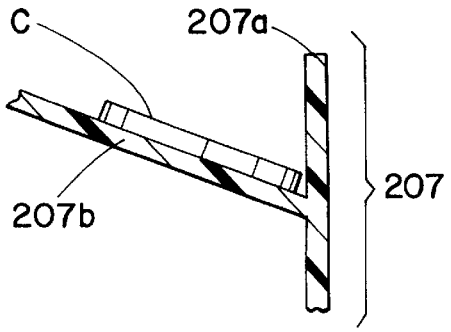
FIGS. 3(*a*) and 3(*b*) are cross-sectional views of the coin guide path of the embodiment of the invention shown in FIGS. 2(*a*) and 2(*b*)
Figure 3B:
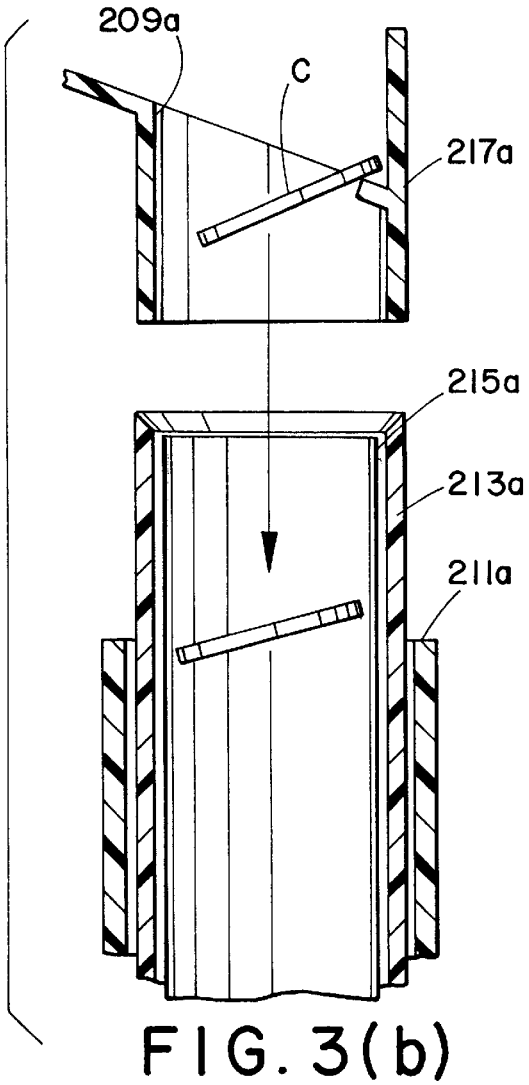

In operation, the user turns on a switch by manipulating switch actuator 221 connected thereto, thus causing the motor to rotate the disk 205. As the disk 205 rotates, coins fed into input port 203 are lifted by disk sockets 204 from hopper 208 to an opening 206 where the coins are individually dropped onto guide path 207. Guide path 207 inclines from the outer wall 207*a* toward the opposite edge as shown in FIG. 3(*a*). In the embodiment shown in FIGS. 2(*a*) and 2(*b*), this incline is directed radially inward along the length of the spiral guide path 207. As seen in FIG. 3(*b*), when a dime reaches aperture 209*a*, which is the smallest aperture, that is, the aperture which is larger than a dime but smaller than a penny, the dime will slide into this aperture and fall through into coin chute 217*a*. Coin chute 217*a* will direct the dime into coin wrapper 215*a* which is held within coin wrapper holder 213*a*. The other coins being larger than a dime, will slide over aperture 209 and farther down the guide path 207 until they reach aperture 209*b*, which is larger than a penny but smaller than a nickel. Pennies reaching this aperture will fall through and into coin chute 217*b*. Coin chute 217*b* will direct the pennies into coin wrapper 215*b* within coin wrapper holder 213*b*. The remaining coins, that is, all coins other than dimes and pennies, will continue to slide along guide path 207 until they reach aperture 209*c*, which is larger than a nickel but smaller than a quarter. Any nickels crossing by this aperture will fall through the aperture and into coin chute 217*c*. Coin chute 217*c* will direct the nickels into coin wrapper 215*c* within coin wrapper holder 213*c*. Thereafter, all remaining coins, that is, all coins other than dimes, pennies, and nickels, will continue to slide along guide path 207 until they reach aperture 209*d*, which is larger than a quarter. Any quarters crossing over this aperture will fall through the aperture and into coin chute 217*d*. Coin chute 217*d* will direct the quarters into coin wrapper 215*d* within coin wrapper holder 213*d*.

Any remaining coins, that is, all coins or tokens other than dimes, pennies, nickels, and quarters will continue to slide along guide path 207 until they reach the end of the guide path and fall into the coin storage chamber 219. As noted above, although not shown, apertures, chutes, coin stacking wells, coin wrapper holders, and coin wrappers designed to accept half dollar coins and dollar coins or any other size coin may be utilized to sort and package theses coins as well.

Figure 4B:
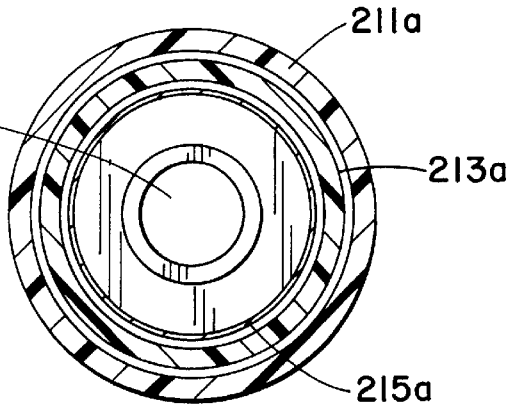
FIG. 4(*a*) is a cross-sectional view of the coin stack produced by the embodiment of the invention shown in FIGS. 2(*a*) and 2(*b*) and FIG. 4(*b*) is a top view of the coin stack of FIG. 4(*a*)
Figure 4A:
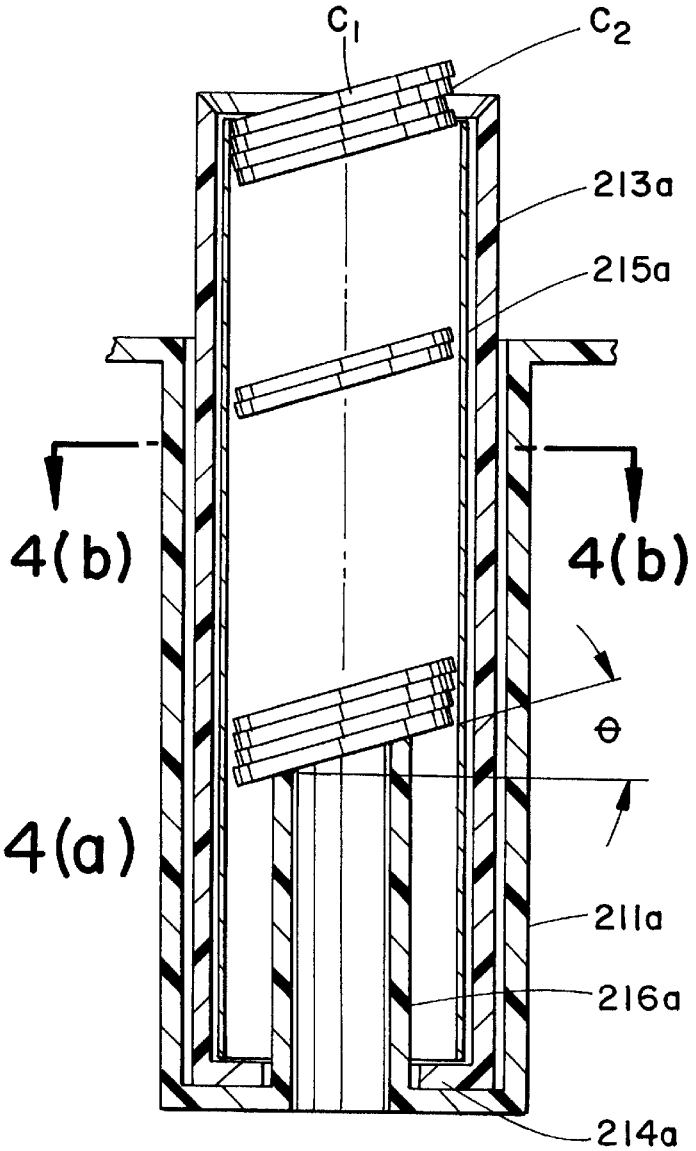

Turning now to FIG. 4(*a*), a more detailed drawing of a coin stack produced by the instant invention is shown. Throughout the remainder of this application a description is given of a single coin stacking well 211*a*, coin wrapper holder 213*a*, and coin wrapper 215*a* combination. Although only one such set of elements is described in detail, corresponding similar elements such as coin stacking well 211*b*, coin wrapper holder 213*b*, and coin wrapper 215*b* serve similar functions, are constructed in a similar manner, and operate in a similar fashion.

In any case, coin wrapper holder 213*a* is shown placed in coin stacking well 211*a* with coin wrapper 215*a* in place within the coin wrapper holder 213*a*. Coin wrapper support ledge 214*a* supports the bottom of coin wrapper 215*a*. Wedge 216*a* holds the received coins C at an angle θ, whereby excess coins $C_1$ and $C_2$ dropped on the stack of coins C above point A will be consistently directed in one direction, as seen in FIG. 5(*a*). Angle θ may preferably be about 35 degrees. Further, as seen in FIG. 6, the excess coins preferably are directed by the orientation of the wedge 216*a* into the coin storage chamber 219.

Moreover, it is noted that the angled nature of the coin stack produced by the instant invention itself automatically provides a more accurate count of the coins within the coin wrapper than the count provided by a conventional horizontal coin stack. FIGS. 5(*b*) and 5(*c*) show, respectively, a detailed cross section of a coin C and a detailed cross section of a conventional horizontal coin stack. As seen in FIG. 5(*b*), a coin has a rim R, depression D adjacent the rim, and a thick center section T. Because of the shape, conventionally stacked coins rock or pivot relative to each other. By stacking the coins at an angle θ, the instant invention provides that the coins will consistently and predictably be stacked such that the rim R of each coin will settle to the same side of the coin wrapper 215*a*–215*d* or coin wrapper holder 213*a*–213*d* within a corresponding depression D in the coin directly underneath. Such stacking consistency provides a highly accurate and repeatable coin count for a particular coin stack height.

In contrast, as seen in FIG. 5(*c*), as the coins are dropped on the conventional horizontal stack, the rim from each coin may settle into the depression of the coin directly underneath to a different side of the coin wrapper or coin wrapper holder. Thus, the height of a stack of a given number of such haphazardly arranged coins will not be consistent and predictable.

Referring now to FIG. 4(*b*), a top view of the coin stack of FIG. 4(*b*) is shown, without coins. Here it is seen that the wedge 216*a* as viewed from above may have a circular cross-section.

Referring to FIGS. 7(*a*) and 7(*b*), which show, respectively, a perspective view of coin wrapper holder 213*a* and a cross-sectional view of coin wrapper holder 213*a*, it is seen that slots 218$a_1$ and 218$a_2$ (not shown) may be formed in opposite sides of the coin wrapper holder 213*a* to permit the user to crimp down the sides of the bottom edge of a coin wrapper placed within the holder or to remove the filled coin wrapper from the coin holder. Such crimping of the sides of the bottom edge of the coin wrapper placed within the holder is possible because the wedge 216*a* is disposed within the coin stacking well 211*a*, rather than in the coin wrapper holder 213*a*. Accordingly, when the coin holder 213*a* is lifted out of coin stacking well 211*a* the coin stack will be held in place by the support ledge 214*a*. The user can then fold over the top of the coin wrapper 215*a*, turn the coin wrapper holder 213*a* upside down so that the coins move to the folded end, crimp the coin wrapper 215*a* through slots 218$a_1$ and 218$a_2$ and push the coin wrapper 215*a* out of the coin wrapper holder 213*a* using the slots 218$a_1$ and 218$a_2$.

It must be noted that although the present invention is described by reference to particular embodiments, many changes and modifications of the invention may become apparent to those skilled in the art without departing from the spirit and scope of the invention, which is only limited by the appended claims. For example, the apertures of the instant invention may of course be sized to sort coins of denominations different from those discussed above.

What is claimed is:

1. A device for stacking coins, comprising:

at least one coin stacking well; and a wedge positioned at a bottom of said coin stacking well, wherein said coin stacking well further comprises a coin wrapper holder, one end of said coin wrapper holder being placed around said wedge, and said coin wrapper holder further comprises a ledge at said one end.

2. The device of claim 1, wherein said wedge comprises a platform section and an angled section, said angled section has an angle of about 35 degrees with respect to said platform section.

3. The device of claim 1, wherein said coin wrapper holder further comprises at least one slot extending through the lip along a portion of said coin wrapper holder.

4. A device for sorting coins and packaging the sorted coins in coin wrappers, comprising:

means for receiving the coins;

guide means for guiding the coins from the means for receiving alone a predetermined path, said guide means having a bottom surface and an outer guide wall;

a plurality of apertures in said bottom surface, each of said apertures becoming progressively larger in a direction substantially coinciding with the predetermined path;

a plurality of coin stacking wells for receiving the coin wrappers and the coins;

a plurality of coin chutes, each coin chute being adapted to direct coins from a respective aperture to a respective coin stacking well;

a plurality of wedges, one wedge being positioned at a bottom of each coin stacking well; and a plurality of coin wrapper holders for holding the coin wrappers, wherein each of said plurality of coin wrapper holders is adapted to be placed within a respective one of said coin stacking wells, and has finger grooves formed on opposite sides of one end to permit the folding over of one end of each coin wrapper placed within each coin wrapper holder.

5. A device for stacking coins, comprising:

at least one coin stacking well, wherein said coin stacking well further comprises a coin wrapper holder, said coin wrapper holder comprising a ledge at one end, said ledge defining at least one slot extending through the ledge.

6. The device of claim 5 further comprising:

means for receiving the coins;

guide means for guiding the coins from the means for receiving along a predetermined path, said guide means having a bottom surface and an outer guide wall;

at least one aperture in said bottom surface of said guide means;

wherein said at least one coin stacking well receives a coin wrapper and the coins; and at least one coin chute which is adapted to direct coins from a respective aperture to a respective coin stacking well.

7. The device of claim 6, wherein the means for receiving comprises a funnel-like input chute and a hopper.

8. The device of claim 6, further comprising a coin movement means for moving the coins from the means for receiving to the guide means.

9. The device of claim 8, wherein the coin movement means comprises a rotating disk.

10. The device of claim 9, wherein the rotating disk is rotated by an electric motor.

11. A device for sorting coins and packaging the sorted coins in coin wrappers, comprising:

means for receiving the coins;

guide means for guiding the coins from the means for receiving along a predetermined path, said guide means having a bottom surface and an outer guide wall;

a plurality of apertures in said bottom surface, each of said apertures becoming progressively larger in a direction substantially coinciding with the predetermined path;

a plurality of coin stacking wells for receiving the coin wrappers and the coins;

a plurality of coin chutes, each coin chute being adapted to direct coins from a respective aperture to a respective coin stacking well; and a plurality of coin wrapper holders for holding the coin wrappers, wherein each of said plurality of coin wrapper holders is adapted to be placed within a respective one of said coin stacking wells, and has finger grooves formed on opposite sides of one end to permit the folding over of one end of each coin wrapper placed within each coin wrapper holder.

12. A device for sorting coins and packaging the sorted coins in coin wrappers, comprising:

a coin receiver for receiving the coins;

a guide path for guiding the coins from the coin receiver along a predetermined path, said guide path having a bottom surface and an outer guide wall;

a plurality of apertures in said bottom surface, each of said apertures becoming progressively larger in a direction substantially coinciding with the predetermined path wherein each coin slides on one face along said guide path until it falls through one of said apertures;

a plurality of coin stacking wells for receiving the coin wrappers and the coins;

a wedge positioned at a bottom of at least one of said coin stacking wells, wherein said at least one of said coin stacking wells further comprises a coin wrapper holder, one end of said coin wrapper holder being placed around said wedge, and said coin wrapper holder further comprises a ledge at said one end;

a plurality of coin chutes, each coin chute being adapted to direct coins from a respective aperture to a respective coin stacking well; and an overflow chamber for receiving excess coins falling away from the coin stacking wells.

13. The device of claim 12, wherein the coin receiver comprises a funnel-like input chute and a hopper.

14. The device of claim 12, further comprising a coin movement means for moving the coins from the coin receiver to the guide path.

15. The device of claim 14, wherein the coin movement means comprises a rotating disk.

16. The device of claim 15, wherein the rotating disk is rotated by an electric motor.

17. The device according to claim 12, further comprising a plurality of wedges, one wedge being positioned at a bottom of each coin stacking well, wherein each wedge has an angled top surface and a side surface.

18. The device of claim 17, wherein the angled top surface of each wedge declines in a predetermined direction.

19. The device of claim 17, wherein each of said plurality of wedges is formed at an angle of about 35 degrees and declines in the direction of said overflow chamber.

20. The device of claim 12, wherein each of said plurality of apertures is slightly larger than a penny, a dime, a nickel, and a quarter, respectively.

21. The device of claim 12, wherein said bottom surface of said guide path inclines from said guide wall to an opposite edge.

22. The device of claim 12, wherein said predetermined path is a spiral.

23. The device of claim 12, further comprising a plurality of coin wrapper holders for holding the coin wrappers.

24. The device of claim 23, wherein each of said plurality of coin wrapper holders is adapted to be placed within a respective one of said coin stacking wells.

25. A coin bank for sorting and storing coins of various sizes, said bank comprising:

a coin receiver for receiving unsorted coins;

a plurality of spaced coin storage containers for storing sorted coins, wherein at least one of said coin storage containers further comprises a coin wrapper holder, said coin wrapper holder comprising a ledge at one end, said ledge defining at least one slot extending through the ledge;

a helical coin sorting path located between said coin storage containers and said coin receiver, said coin sorting path comprising a base wall, a plurality of spaced apertures of varying size located in said base wall, each aperture being sized to allow passage only of coins having a diameter less than a predetermined size, said apertures being arranged in increasing order of size wherein each coin slides on one face along said helical coin sorting path until it falls through one of said apertures; and an overflow container located at a downstream end of said coin sorting path for accommodating coins which do not fit in said plurality of coin storage containers.

26. A coin bank comprising:

a generally cylindrical housing;

a coin receiver for receiving coins;

at least one coin stacking well;

a helical guide path comprising a bottom wall, and an outer side wall, said guide path extending along an interior of said housing from said coin receiver to said at least one coin stacking well, wherein said bottom wall is radially and upwardly inclined from said outer side wall towards said interior of said housing; and at least one coin wrapper holder disposed in said coin stacking well, wherein said coin wrapper holder further comprises a ledge at one end of said coin wrapper holder.

27. The coin bank of claim 26 wherein said bottom wall of said helical guide path defines a plurality of spaced apertures of varying size.

28. The coin bank of claim 27 wherein each said coin stacking well is disposed directly under a respective aperture defined in said bottom wall of said helical guide path.

29. The coin bank of claim 28 wherein each said aperture is sized to allow passage only of coins having a diameter less than a predetermined size, said apertures being arranged in increasing order of size wherein each coin slides on one face along said helical guide path until it falls through one of said apertures into said coin stacking well disposed directly thereunder.

30. A coin bank comprising:

a generally cylindrical housing;

a coin receiver for receiving coins, said receiver disposed within said housing;

a plurality of coin stacking wells, each of said wells disposed under said receiver; and a plurality of coin wrapper holders, each said coin wrapper holder disposed in one of said plurality of coin stacking wells, and each said coin wrapper holder comprising a ledge at one end, said ledge defining at least one slot extending through the ledge.

* * * * *